US009414985B2

(12) United States Patent
Ugartechea Berlanga et al.

(10) Patent No.: US 9,414,985 B2
(45) Date of Patent: Aug. 16, 2016

(54) MODULAR SYSTEM FOR NICHES OR CRYPTS FOR DEPOSITING ASHES AND/OR DRY REMAINS

(71) Applicant: Mausoleum, S.A. DE C.V., Queretaro, Queretaro (MX)

(72) Inventors: Alejandro Ugartechea Berlanga, Queretaro (MX); Emilio Linares Limon, Queretaro (MX)

(73) Assignee: Mausoleum, S.A. DE C.V., Queretaro, Queretaro (MX)

( * ) Notice: Subject to any disclaimer, the term of this patent is extended or adjusted under 35 U.S.C. 154(b) by 0 days.

(21) Appl. No.: 14/691,600

(22) Filed: Apr. 21, 2015

(65) Prior Publication Data

US 2015/0308141 A1 Oct. 29, 2015

(30) Foreign Application Priority Data

Apr. 23, 2014 (MX) ..... MX/a/2014/004874

(51) Int. Cl.
*A61G 99/00* (2006.01)
*E04H 13/00* (2006.01)

(52) U.S. Cl.
CPC ..... *A61G 99/00* (2013.01); *E04H 13/008* (2013.01)

(58) Field of Classification Search
CPC E04H 13/006; E04H 13/008; A47B 47/0016; A47B 47/0025; A47B 47/042; A47B 87/0207; A47B 87/0276; A61G 99/00
USPC ..... 52/135
See application file for complete search history.

(56) References Cited

U.S. PATENT DOCUMENTS 1,281,856 A * 10/1918 Shaw ..... A63H 33/105 211/189
3,642,339 A * 2/1972 Ruderfer ..... A47B 55/04 211/151
3,661,434 A * 5/1972 Alster ..... A47B 47/005 312/108
3,685,465 A * 8/1972 Haumer ..... A47B 47/0041 108/60
3,754,805 A * 8/1973 Pangburn ..... F16B 12/18 211/84
3,762,115 A * 10/1973 McCaul, III ..... E04B 1/34823 52/236.6
3,836,218 A * 9/1974 Hallal ..... F16B 12/02 312/108
3,841,726 A * 10/1974 Andros ..... A47B 47/0041 211/189
3,878,656 A * 4/1975 Duwe ..... E04H 13/006 52/134
3,905,169 A * 9/1975 Gallo ..... E04H 13/006 52/137
4,021,127 A * 5/1977 Gasparro ..... A47B 47/005 403/171
4,048,772 A * 9/1977 Gaul ..... E04H 13/006 52/136

(Continued)

*Primary Examiner* — James Ference
(74) *Attorney, Agent, or Firm* — Fraser Clemens Martin & Miller LLC; James D. Miller

(57) ABSTRACT

A modular system of niches or crypts for the deposit of ashes and/or dry remains with easy assembly which does not require high skill training. The modular system can have different heights and widths of the niches, which is possible by the use of connectors. The modular system for crypts can be recoated with an aesthetically pleasing to the eye material, such as ceramic, marble or other materials.

13 Claims, 8 Drawing Sheets

(56) References Cited

U.S. PATENT DOCUMENTS 4,073,100 A * 2/1978 DiGiovanni, Jr. ..... E04H 13/006 52/136
4,110,052 A * 8/1978 Polvara ..... F16B 5/0614 312/111
4,301,636 A * 11/1981 Luria ..... A47B 47/0025 312/111
4,989,382 A * 2/1991 Spronken ..... E04H 13/006 52/134
5,243,794 A * 9/1993 Pikor ..... E04H 13/006 52/136
5,466,057 A * 11/1995 Blankenburg ..... A47B 87/005 312/108
5,477,594 A * 12/1995 LePage ..... E04H 13/006 211/194
5,803,782 A * 9/1998 Selton ..... A47B 47/0016 446/125
5,894,699 A * 4/1999 Fulton ..... E04H 13/006 52/128
5,899,045 A * 5/1999 Giannarelli ..... E04H 13/006 27/1
6,098,350 A * 8/2000 Kochtitzky ..... E04H 13/006 52/134
6,105,315 A * 8/2000 Stoecklein ..... E04H 13/006 27/1
6,250,025 B1 * 6/2001 Darby ..... E04H 13/006 52/137
6,578,323 B1 * 6/2003 Zartman ..... E04H 13/006 27/1
6,732,858 B1 * 5/2004 Chang Ou ..... A47B 87/0276 206/278
D555,399 S * 11/2007 Tsai ..... D6/675.1
7,415,800 B2 * 8/2008 Stienwand ..... E04H 13/006 109/68
7,739,776 B2 * 6/2010 Hume ..... E04H 13/008 27/1
7,866,769 B2 * 1/2011 Ahlgrim ..... A47B 43/02 312/108
7,918,515 B2 * 4/2011 Wang ..... A47B 87/005 211/194
7,926,228 B1 * 4/2011 Snow ..... E04H 13/008 27/35
7,967,401 B2 * 6/2011 Hsu ..... A47B 47/0008 312/108
D745,820 S * 12/2015 Alvarez Brena ..... D25/199
2004/0222722 A1 * 11/2004 Yang ..... A47B 47/0041 312/265.5
2005/0200250 A1 * 9/2005 Zillmann ..... F16B 12/2027 312/265.5
2007/0132345 A1 * 6/2007 Lai ..... A47B 47/005 312/265.4
2007/0175110 A1 * 8/2007 Bosisio ..... E04H 13/008 52/136
2007/0261331 A1 * 11/2007 Rickards ..... E04F 13/0839 52/235
2008/0078074 A1 * 4/2008 McCampbell ..... E04H 13/006 27/1
2009/0229197 A1 * 9/2009 Bach Lahor ..... E04H 13/006 52/142
2009/0282752 A1 * 11/2009 Stilnovich ..... E04H 13/006 52/133
2010/0275529 A1 * 11/2010 Bridgemen ..... E04H 13/006 52/134
2010/0300016 A1 * 12/2010 Eickhof ..... E04H 13/006 52/136
2011/0154748 A1 * 6/2011 Young ..... E04H 13/006 52/136
2011/0241505 A1 * 10/2011 Tashjian ..... A47B 87/0276 312/198
2012/0042489 A1 * 2/2012 Cai ..... E04H 13/006 27/35
2012/0167488 A1 * 7/2012 Eickhof ..... E04H 13/006 52/139
2013/0199111 A1 * 8/2013 Eickhof ..... E04H 13/006 52/134
2015/0308141 A1 * 10/2015 Ugartechea Berlanga ..... E04H 13/006 52/135

* cited by examiner

MODULAR SYSTEM FOR NICHES OR CRYPTS FOR DEPOSITING ASHES AND/OR DRY REMAINS

FIELD OF THE INVENTION

Present invention refers to a modular system for niches or crypts for the deposit of ashes and/or dry remains. In a more specific manner, present invention refers to a modular system with easy assembly for the deposit of ashes and/or dry remains.

BACKGROUND OF THE INVENTION

Presently there are various types of crypts or niches, among which are those known as locker type crypts which have a sheet based manufacture. These types of crypts are usually easier to install than the crypts made based on bricks and cement. However, the sheet crypts have the disadvantage of being aesthetically unpleasant given the laminate sheet finish. Another disadvantage of the laminate sheet based crypts is that the sheet can present problems related to oxidation as well as with maintenance costs.

Another type of crypts which are known in the state of the art are those manufactured by means of a piece of furniture based on a frame made up of rectangular section tubing joined to each other by special aluminum connectors. Said tubing, as well as the divisions and shelves, are built based on a "zintro-alum" steel sheet with a high resistance aluminum, zinc, and silicon alloy. The main disadvantage of this type of manufacturing, lies in the fact that in addition to the manufacturing costs being too high, and it also requires highly trained personnel for installing the crypts in their final resting place, thereby increasing the installation costs.

In prior art methods are also known for constructing crypts based on a modular system which consists with a plurality of crypts, where each individual crypts comprises a frame formed by steel profiles which are joined by means of an autogenous welding, inner divisions for support, and lateral and back divisions which are fixed by means of rivets to the frame. Even though said methods achieve overcoming many of the inconveniences and disadvantages of the previous techniques, the enormous disadvantage still exists of not having the ability of being able to be installed in any climate and location, given that due to its being manufactured with profile tubing and/or sheet laminate the bothersome problems of oxidation still persist. Additionally, the crypt assembled by means of said methods is difficult to handle and transport given its size and weight, in addition to the lengthy amount of manufacturing time as it is a more highly artisan system. Another defect present is the sight of the product given that the mentioned materials end up being a low quality type which results in being less visually pleasing.

BRIEF DESCRIPTION OF THE INVENTION

The present invention refers to a modular system for niches or crypts for the deposit of ashes and/or dry remains with easy assembly, where the assembly is carried out in a fast and safe manner thanks to the connectors set in present invention.

BRIEF DESCRIPTION OF THE FIGURES

The particular features and advantages of the invention, as well as other objectives of the invention, shall become apparent, taken in conjunction with the accompanying figures, in which.

DETAILED DESCRIPTION OF THE INVENTION

Figure 1:
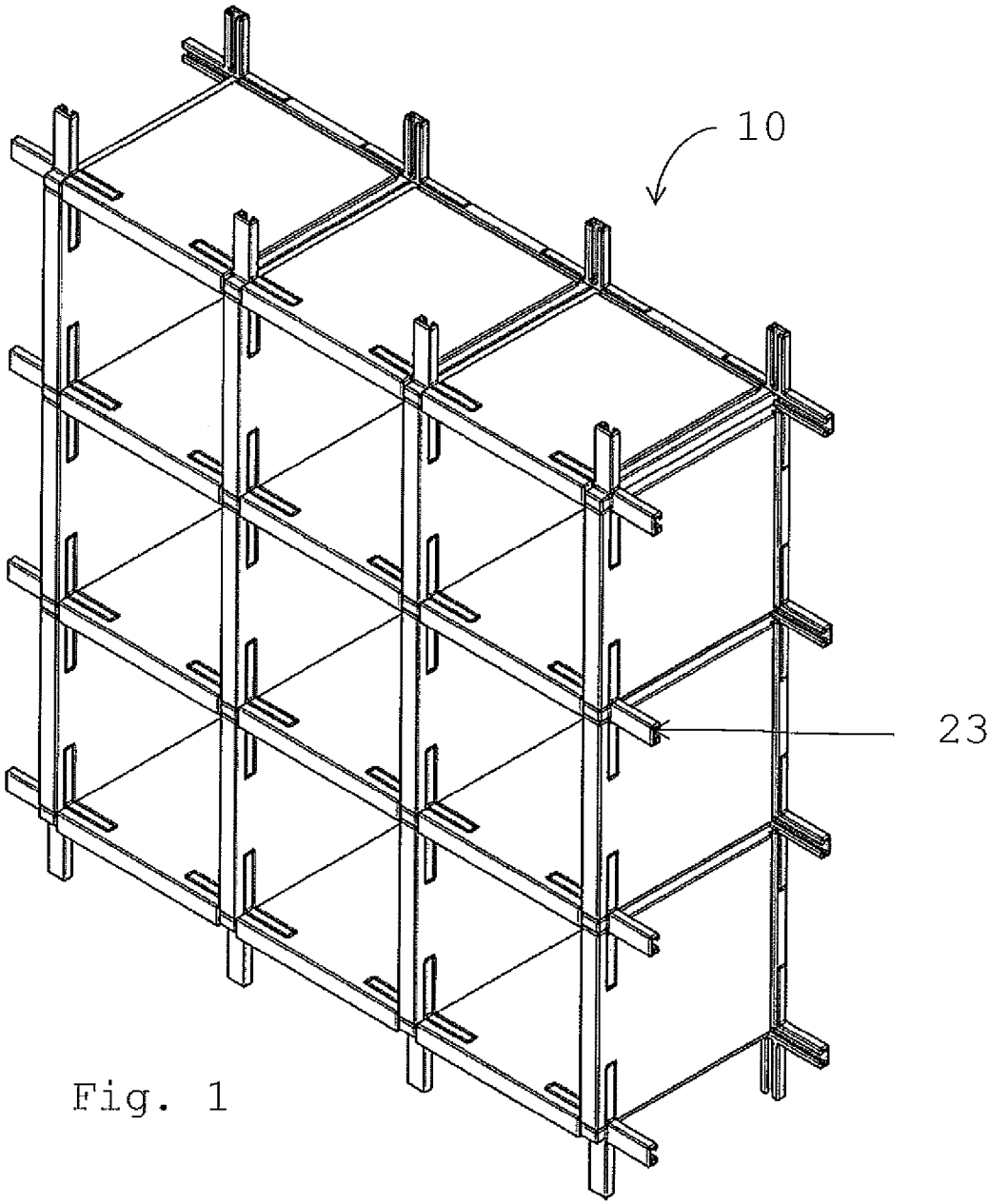
FIG. 1 is a front perspective view of the modular crypt system of present invention.

The following description references FIGS. 1 through 11 of present application in an indistinct manner, in which the modular system of niches or crypts 10 can be seen, which are formed by different assembly modules 20 for the depositing of ashes and/or dry remains.

The modular system 10 can be mounted in open and/or enclosed areas in a very easy, fast way and without the need of requiring anyone with a prior high skilled level for its installation. Examples of open areas where the modular system 10 could be installed include cemeteries, church yards or any area in the open air suitable for said purposes. The modular system 10 can also be installed in appropriate enclosed areas.

The modular system for niches or crypts 10 is made up of at least two assembly modules 20. The assembly modules 20 are formed by horizontal plates 21 and by vertical plates 22 which are interconnected by means of connector elements 23', 23" and/or 23'". Said connector elements have at least two arms (36). The horizontal plates and/or vertical plates may be manufactured of various materials which do not bend easily but which in turn do have a certain amount of flexibility such as plastics, woods, metals which tend to have certain flexibility such as aluminum, cardboard, corrugated cardboard, etc.

The laminate plates 21, 22 can be recoated with an aesthetically pleasing material, such as ceramic or marble or even yet a light layer of cement as for example cellular concrete with the end goal that the modular systems have both an adequate support as well as a visually pleasing aesthetic. Additionally, given that the sheets are made of materials such as aluminum or stainless steel they can be highly resistant to environmental conditions such as, for example oxidation. Additionally, given that the sheets can be recoated with some of the above mentioned materials, the sheet which is still made of a material which can become oxidized would be maintained in optimal conditions thanks to the recoating with any adequate material which additionally grants it a visually acceptable aesthetic.

The assembly modules 20 can be of a width and a height which by way of example, but not limited to, approximately between 25 cm by 40 cm to approximately between 35 cm by 40 cm and a depth of approximately between 20 cm to approximately 60 cm. However, the modular system for niches and crypts 10 can contain assembly modules 20 of various sizes, that is, the connector elements 23', 23" or 23'"

in conjunction with the horizontal plate 21 and the vertical plate 22 allow for a variety of sizes of the width and the height of the assembly modules 20, in this way allowing a design for the modular system 10 according to the client's specifications.

Figure 10:
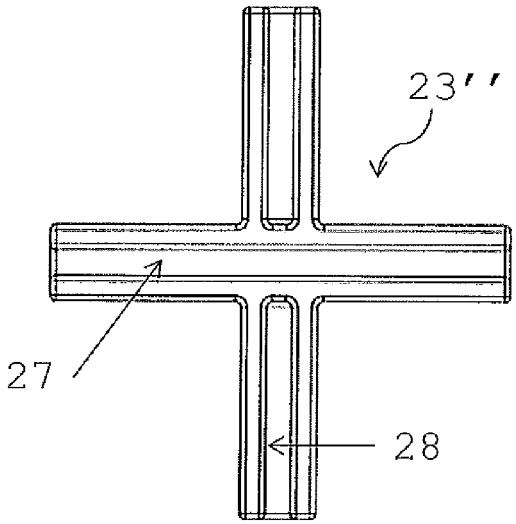
Figure 11:
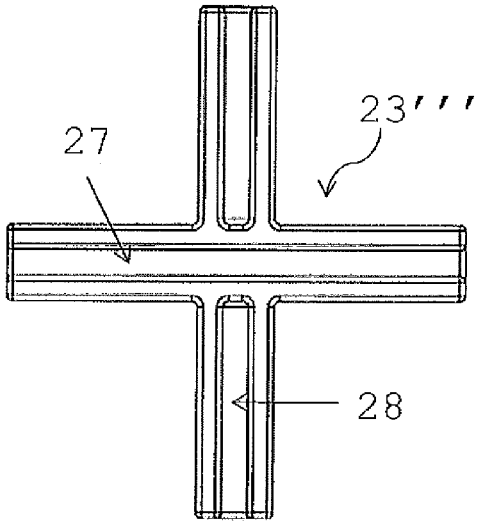
Figure 12:
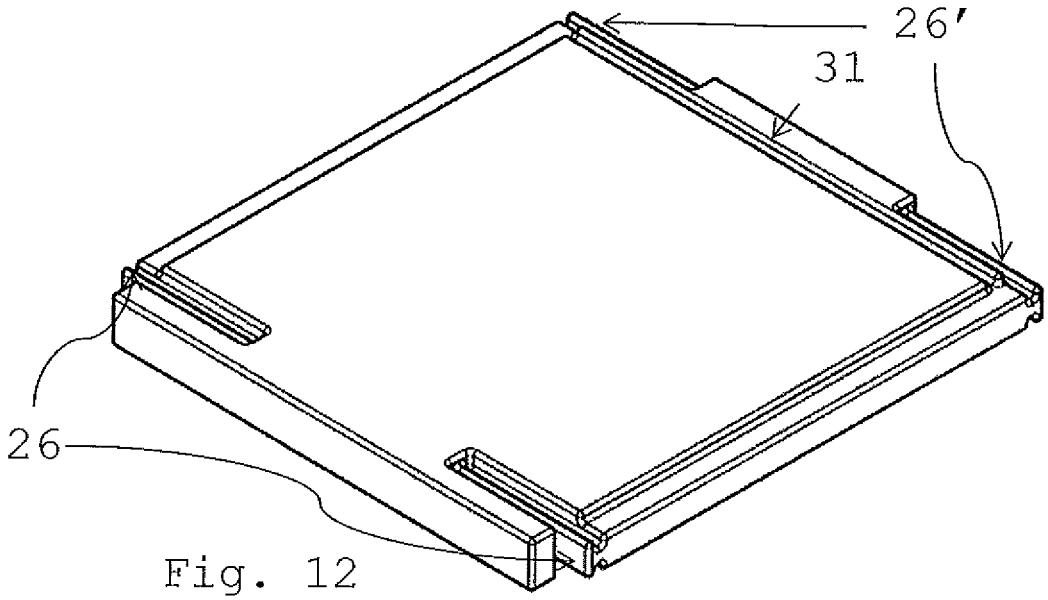
FIG. 12 shows the flanges set on the plates, into which the connector elements are introduced into.
Figure 13:
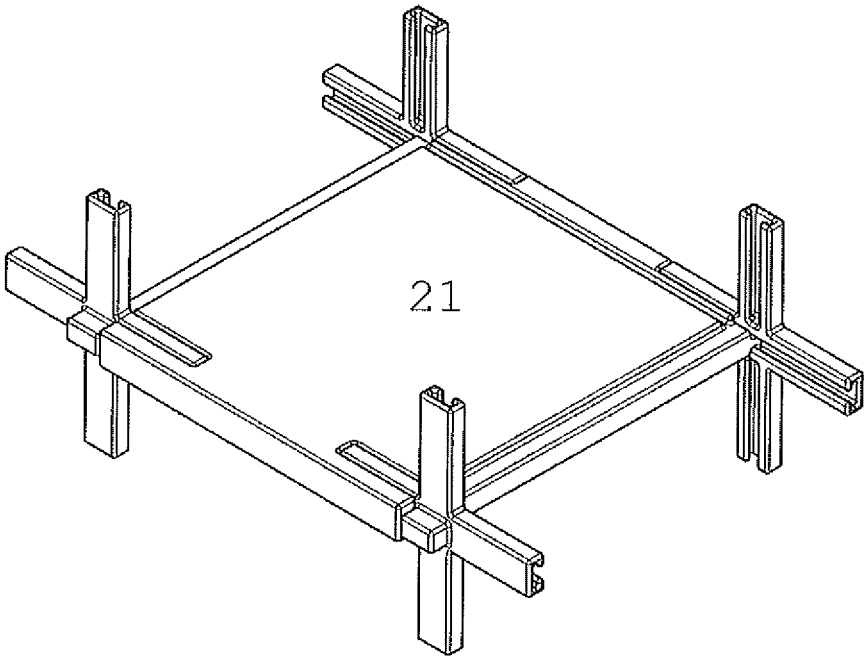
FIG. 13 shows one connector element assembled unto the horizontal plates.
Figure 14:
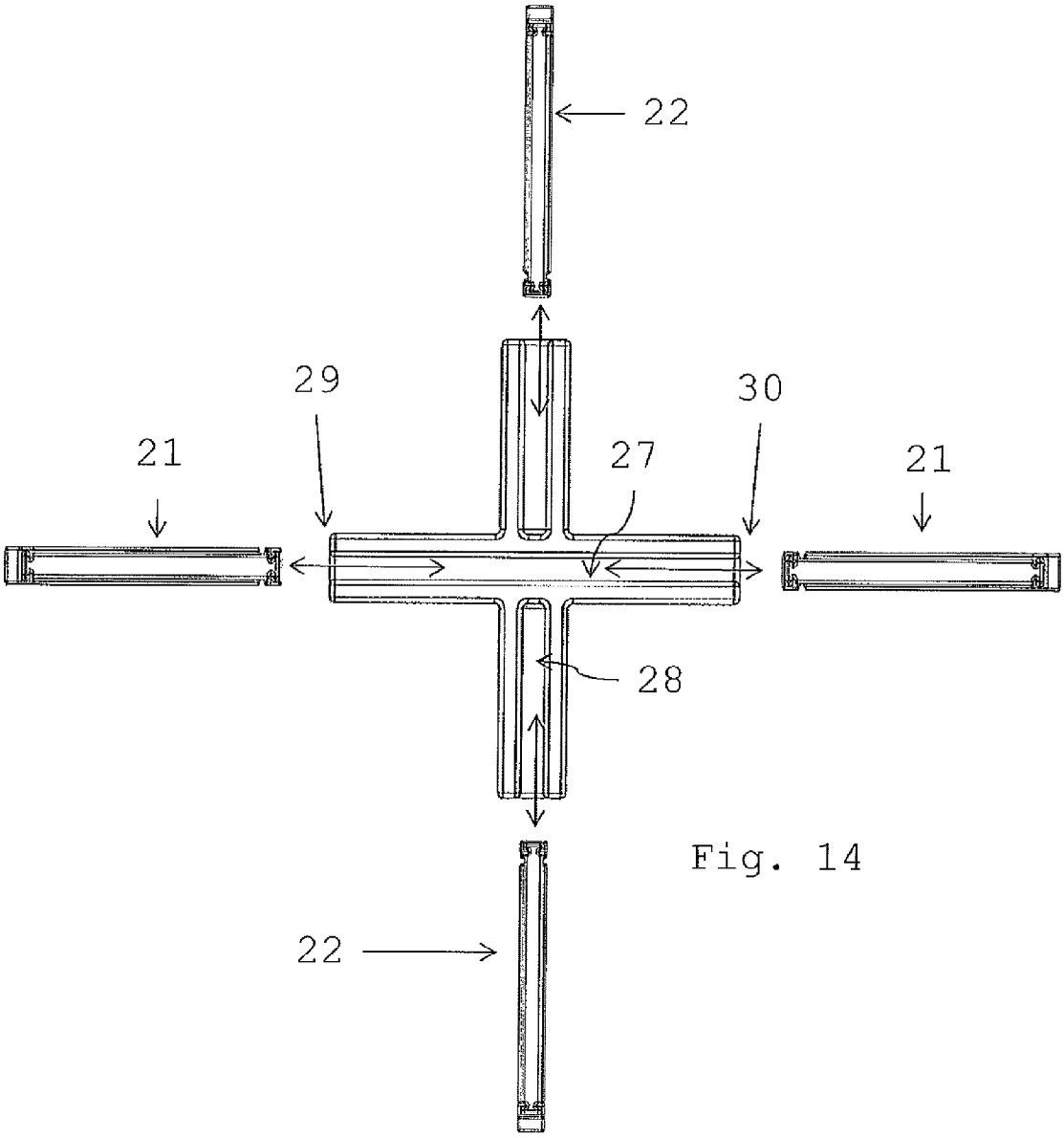
FIG. 14 shows one connector element assembled unto the horizontal and vertical plates.

The assembly modules 20 are constructed by means of horizontal plates 21 and vertical plates 22 connected by means of connector elements 23', 23" and/or 23''' through its arms. As can be seen from the figures, all the plates 21 and 22 have two cavities 24 which are near to a first end and two recesses 25 on a second end opposite to the first end, into which any of the connector elements 23', 23" and/or 23''' could be introduced into, such as is shown in FIGS. 10 and 11. Each cavity 24 is found near the lateral parts of the first end, while each recess 24 is found on the lateral parts of the second end.

Figure 9:
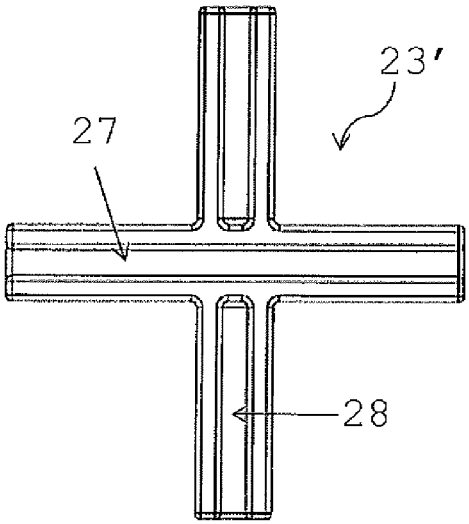
FIGS. 9 through 11 show back views of the different connector elements.

At the second end of the plates 21 and 22, flanges are found 26 and 26' such as can be seen starting in FIG. 9. It should be mentioned that said flanges 26 and 26' are constructed in such a way that the connector elements 23', 23" and/or 23''' can be introduced in an easy way; specifically, the connector elements can be slideable along the length of the recess 24 encircling said flange 26, such as will be described. The connector elements 23', 23" and/or 23''' have on their back part a horizontal aperture 27 and a vertical aperture 28, both in the shape of a "C". More preferably, the connectors 23', 23" and/or 23''' are constituted by at least five different walls. A first wall with a first length has a first direction. A second wall with a second length has a second direction substantially perpendicular to the first wall. A third wall with a third length has a third direction which is vectorially opposite to the first direction and consequently substantially perpendicular to the second wall. A fourth wall with a fourth length has a fourth direction which is vectorially opposite to the second direction and consequently substantially perpendicular to the third wall. Finally a fifth wall with a fifth length, similar to the first length, has a fifth direction which is vectorially opposite to the first direction and consequently substantially perpendicular to the fourth wall. Between the first and fifth wall, same which are opposite, an aperture 27 is formed. The length of the third wall is equivalent to the sum of the first wall, the fifth wall and the aperture. In this way, between the walls of the connectors 23', 23" and/or 23''' an inner space is formed. The inner space of the connectors is configures to receive the flanges of the plates 21 and/or 22 within the same, in such a way that upon sliding the connectors in the inner space, said connectors, by means of their walls encircle the flanges 26, 26' of the plates and wherein the first and fifth wall of the connectors, upon the connectors with the plates being in a mounted position, they are in near proximity to the corresponding cavity 24 and/or the recess 25. Similarly, the plates 21 and 22 have a central rim ledge 31, a first lateral rim ledge 33 and a second lateral rim ledge 32, wherein the second lateral rim ledge is opposite to the first lateral rim ledge. As can be seen, starting from FIG. 11, the upper part of the connectors 23', 23" and/or 23''' has a horizontal aperture 27 which begins at an end 29 and ends at an end 30 opposite to the end 29, that is, the aperture 27 is continuous along the length of the horizontal axis of the connector element 23', 23" and/or 23'''. The aperture is introduced into the flanges 26 of the plate 21 and the connector slides horizontally up until the central rim ledge allows it to, such as is shown in FIG. 10. In this way the cavities 24 of the plate 21 remain occupied by the connector elements 23', 23" and/or 23'''. Similarly, the flanges 26' of the plate 21 are introduced into the apertures 27 of the connectors 23''', wherein the connectors 23''' slide horizontally until they come into contact with a central rim ledge, which limits the horizontal movement of the connectors such as is shown in FIG. 10. In this way the horizontal plate 21 is assembled with the connectors 23', 23" and/or 23''' through its arms, in such a way that the back part of the connectors 23' or 23" is oriented with the back part of the connectors 23'''. As can be seen starting from FIG. 1, the rim ledge 34, 35 of the connectors 23'or 23" remains exposed in view such that the arms of the connector elements 23''' remain hidden from view.

The connector elements 23', 23" and/or 23''' allow connecting different sizes of horizontal plates and/or vertical plates by means of connector arms, in this way allowing for variation in the size of the vertical plates and/or horizontal plates, that is to say, assembly modules 20 can be constructed in different sizes by varying the length of the horizontal or vertical plates, whether it is the width, the height or both to achieve a modular system 10 in different sizes of the assembly module 20. For example, the client or clients can request a niche or crypt in a smaller size, while other desire one of a larger size, which is possible thanks to the connector elements 23', 23" and/or 23''' which are being described in present invention, given that they would allow to construct a modular system 20 according to the different needs of the clients.

The connector elements 23', 23" and/or 23''' have similar connection structural features, the difference being the intermediate element 34, 35 which is found in the same.

Figure 6:
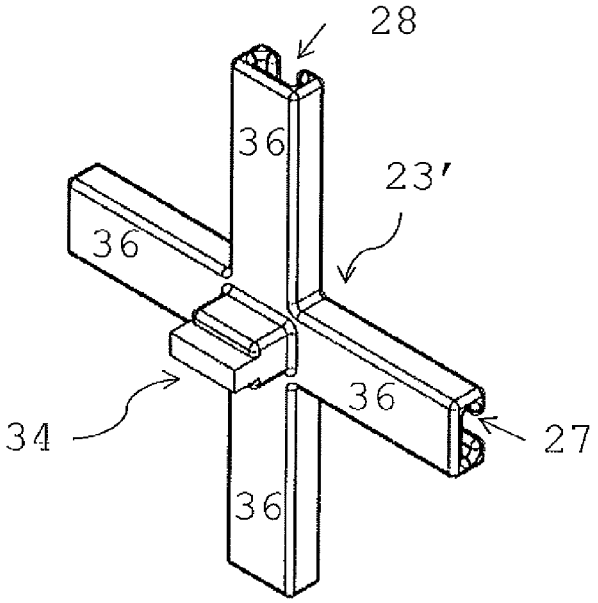
FIGS. 6 through 8 show general perspective views of the different connector elements which may be used to interconnect the horizontal plate and the vertical plate.
Figure 7:
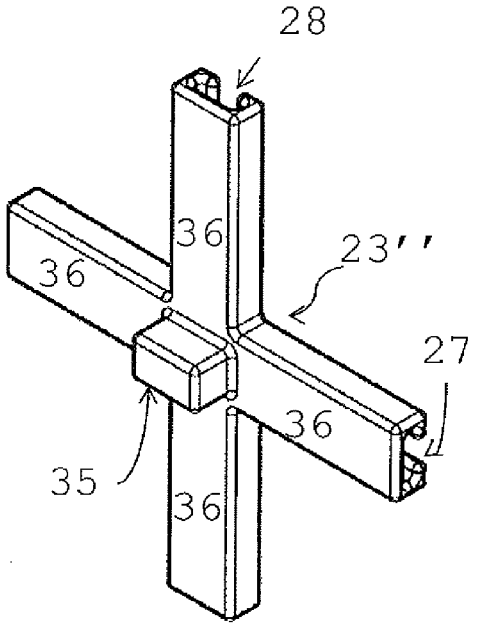

The connector element 23' has an intermediate element 34 which is beveled and which rests over a vertical plate and/or supports a vertical plate, as can be seen for example starting from FIG. 1. The intermediate element 34 in a preferred embodiment can have an intermediate element which is longer than that which is shown in FIG. 6 (not shown).

The intermediate element in another preferred embodiment can have a more rectangular shape, in this way forming an intermediate element 35, which itself also provides support to the modular system 20 in its assembled position.

Figure 8:
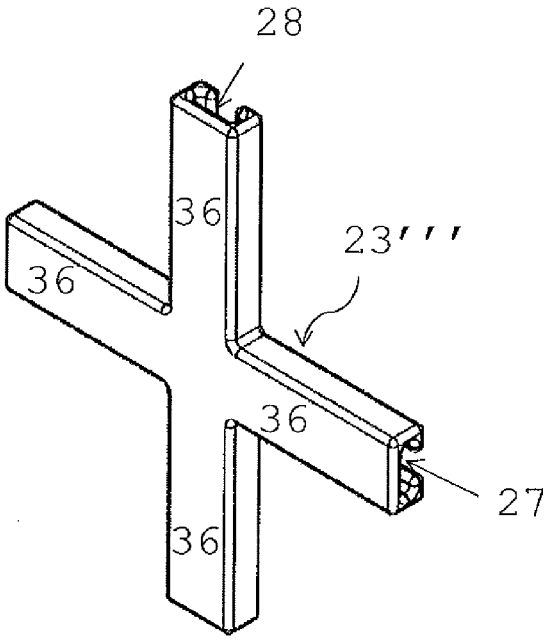

In yet another preferred embodiment, the connector element does not possess any beveled element, as can be seen for example starting from FIG. 8. However, said connector element is found oriented in such a way that it remains hidden from human view, that is, it is found at the back part of the modular system.

Figure 4:
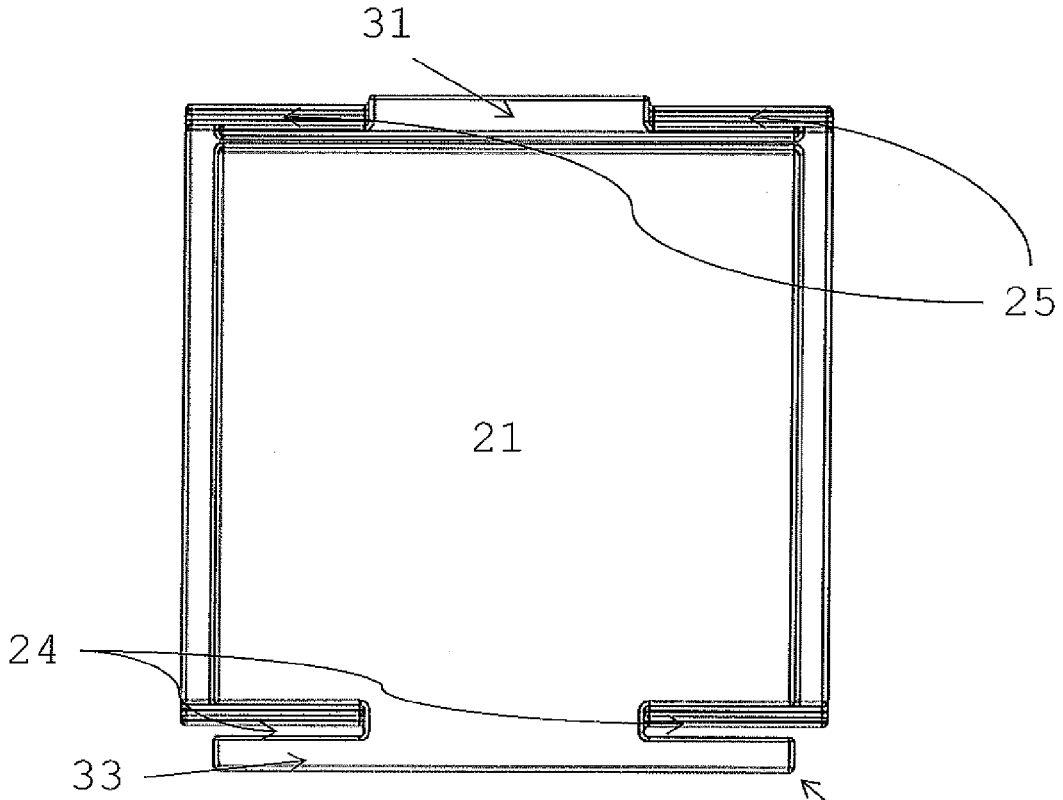
FIG. 4 is a front perspective view of a horizontal plate which makes up the assembled module of FIG. 2.
Figure 5:
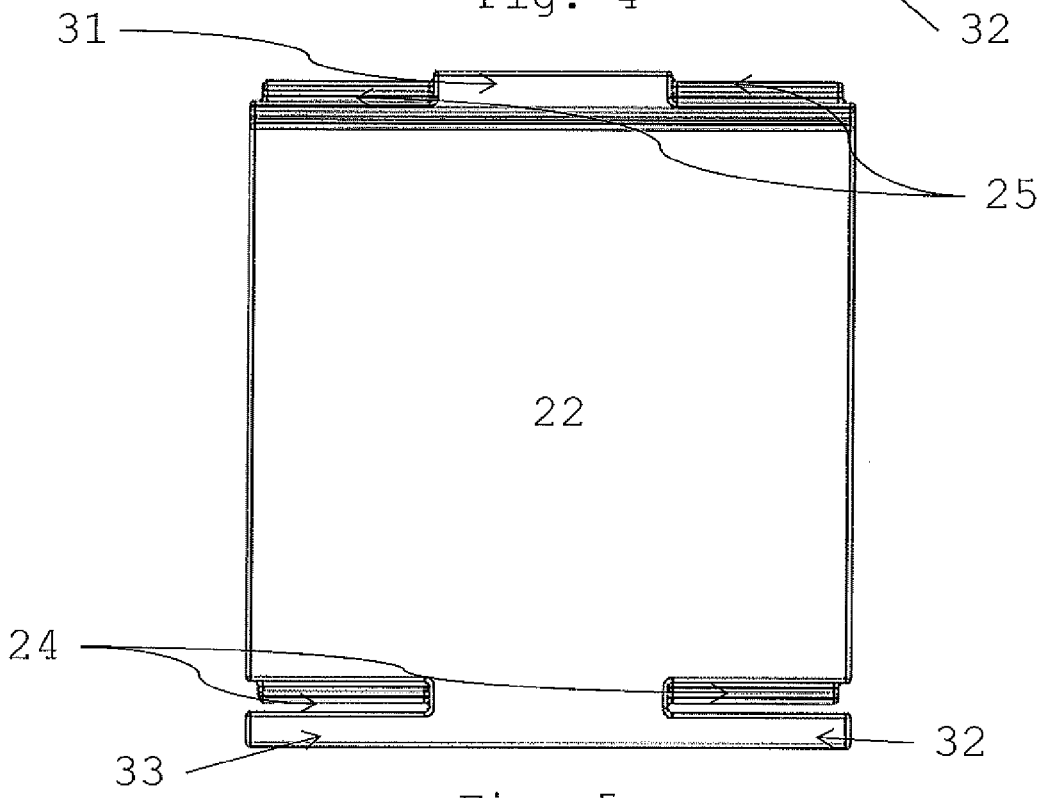
FIG. 5 is a front perspective view of a vertical plate which makes up the assembled module of FIG. 2.

As can be seen starting from FIGS. 4 and 5, the lateral rim ledges 32 and 33 of the plate 22 and the lateral rim ledges 32 and 33 of the plate 21 have distant lengths, that is, the length of the lateral rim ledges 32 and 33 of the plate 21 are longitudinally smaller than the lateral rim ledges 32 and 33 of the plate 22. The lateral rim ledges 32 and 33 of the plate 21 are smaller with the end goal that any of the connectors 23 (23', 23" and/or 23''') can correctly couple the plates 21 and 22 in a firm and secure manner.

Figure 3:
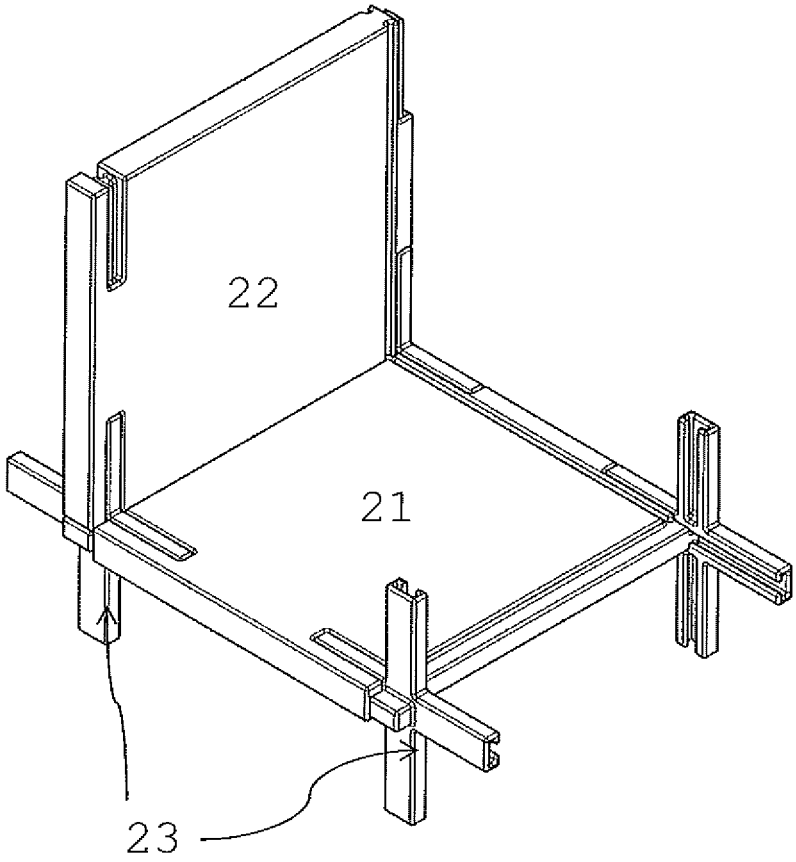
FIG. 3 is a semi-broken up view of the elements which make up the assembled module of FIG. 2.

As was mentioned previously, the connectors 23', 23" and/or 23''' have an inner space into which the flanges 26 and 26' of the plates 22 are introduced into, where the connectors slide in a vertical manner and wherein the rim ledge 31, 32 and 33 limit the vertical movement such as is shown, for example in FIG. 3.

It should be mentioned that the rim ledges 32 and 33 of the plates 21 and 22 remain exposed in full view, in so far as the rim ledges 31 of the plates 21 and 22 are found at the back part, that is, they remain hidden from view.

Figure 2:
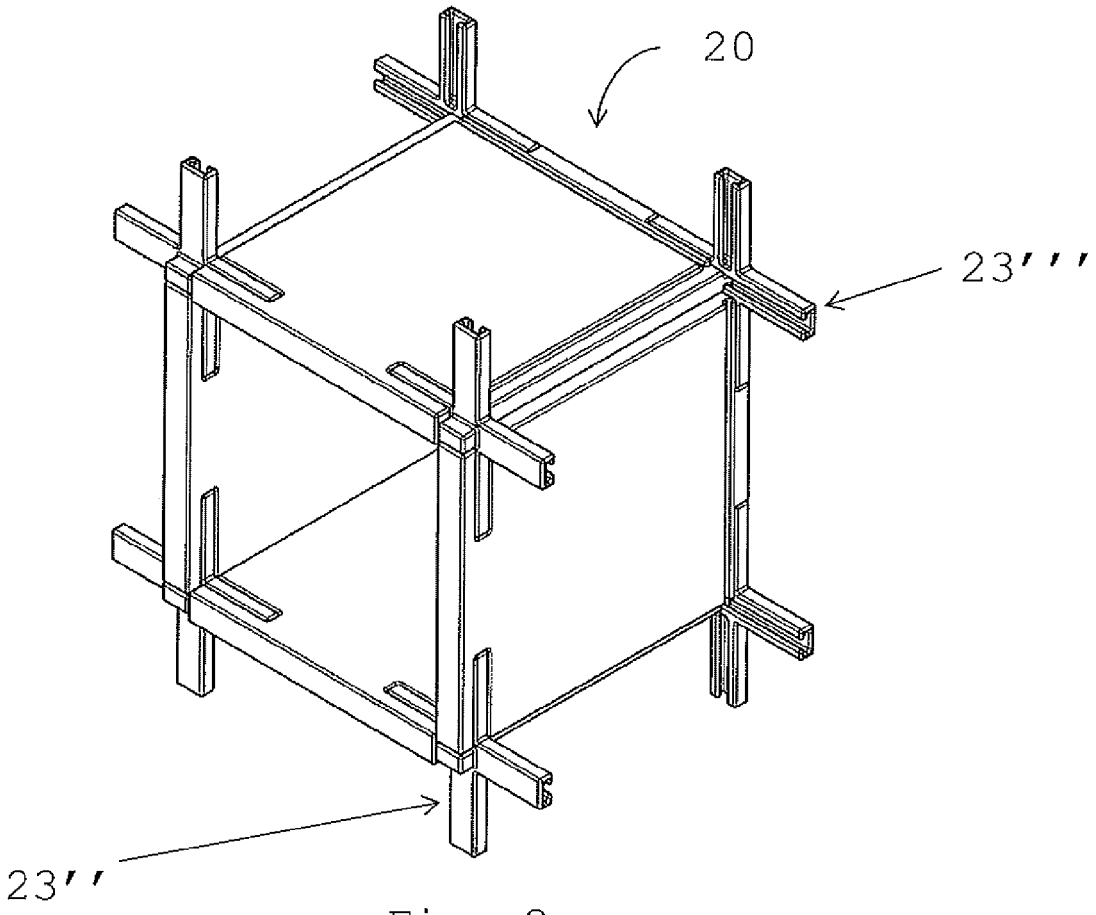
FIG. 2 shows an assembled module of the modular system of FIG. 1.

A horizontal plate 21 and a vertical plate 22 once assembled, as is shown in FIG. 3, the procedure is repeated with the end goal of assembling an assembly module 20 as is shown in FIG. 2 and the connector elements 23', 23" and/or 23''' will allow the addition of however many more assembly modules 20 will be necessary.

The vertical plates have four orifices uniformly distributed towards the center (not shown) which have the objective of providing ventilation to the dry remains.

The arms of the connector elements 23', 23" and/or 23"' may be of different lengths with the end goal of achieving niches or crypts of various sizes, and also to be able to meet different design requirements according to the specifications of the clients, dimensions of the places where they will be placed, among other considerations.

Persons skilled in the art will easily understand how changes to the present invention can be accomplished without deviating from the summarized concepts of the above description. It is considered that these changes are included to lie within the claimed scope of present model. Consequently, the particular embodiments previously described in detail are merely illustrative and not limitative in terms of the scope of present model, to which full extension of the attached claims should be granted, in addition to all and any equivalent of the same.

The invention claimed is:

1. A modular system of crypts comprising:

at least one first plate;

at least one second plate substantially perpendicular to the at least one first plate, wherein each of the at least one first plate and the at least one second plate includes a first end having a first central rim ledge, a first lateral rim ledge, and a second lateral rim ledge, the first lateral rim ledge arranged opposite the second lateral rim ledge, wherein each of the at least one first plate and the at least one second plate further includes two cavities formed therein, each of the cavities formed between one of the first lateral rim ledge and the second lateral rim ledge and a corresponding lateral side of one of the at least one first plate and the at least one second plate, each of the cavities having at least one flange; wherein each of the at least one first plate and the at least one second plate further includes a second end having a second central rim ledge and two recesses arranged opposite to each other and at lateral portions of the second end;

at least one connector element having at least four arms and having on a back part a first wall, a second wall, a third wall, a fourth wall, and a fifth wall cooperating to define a horizontal aperture, wherein a pair of vertical arms of the at least four arms of the at least one connector element include a first vertical aperture and a second vertical aperture, wherein the horizontal aperture is substantially perpendicular to each of the first vertical aperture and the second vertical aperture;

wherein the at least one flange of each of the cavities slides into one of the horizontal aperture, the first vertical aperture, and the second vertical aperture of the at least one connector element until the at least one connector element comes into contact with one of the first central rim ledge or the second central rim ledge to limit a horizontal and a vertical movement of the at least one connector element to connect the at least one connector element with the at least one first plate and the at least one second plate.

2. The modular system of crypts according to claim 1, wherein the at least one second plate has at least four orifices to maintain dry remains in a dry state.

3. The modular system of crypts according to claim 1, wherein the at least one connector element has a beveled first intermediate element, wherein a second intermediate element protrudes from the beveled first intermediate element.

4. The modular system of crypts according to claim 1, wherein the at least one connector element has an intermediary element which has a rectangular shape.

5. The modular system of crypts according to claim 1, wherein the first wall of the at least one connector element has a first length and a first direction.

6. The modular system of crypts according to claim 5, wherein the second wall of the at least one connector element has a second length substantially perpendicular to the first length of the first wall.

7. The modular system of crypts according to claim 6, wherein the third wall of the at least one connector element has a third length and a third direction which is vectorially opposite to the first direction and substantially perpendicular to the second wall.

8. The modular system of crypts according to claim 7, wherein the fourth wall of the at least one connector element has a fourth direction which is vectorially opposite to the second direction and substantially perpendicular to the third wall.

9. The modular system of crypts according to claim 8, wherein the fifth wall of the at least one connector element has a fifth length similar to the first length with a fifth direction which is vectorially opposite to the first direction and substantially perpendicular to the fourth wall.

10. The modular system of crypts according to claim 1, wherein the first vertical aperture, the second vertical aperture, and the horizontal aperture have a "C" shaped cross-section.

11. The modular system of crypts according to claim 1, wherein the flanges are in a "T" shape.

12. The modular system of crypts according to claim 1, wherein the first lateral rim ledge and the second lateral rim ledge of the at least one first plate each have different lengths from the first lateral rim ledge and the second lateral rim ledge of the at least one second plate.

13. The modular system of crypts according to claim 12, wherein the length of each of the first lateral rim ledge and the second lateral rim ledge of the at least one first plate is longitudinally shorter than the length of each of the first lateral rim ledge and the second lateral rim ledge of the at least one second plate.

* * * * *